United States Patent [19]

Bergh et al.

[11] 4,099,647

[45] Jul. 11, 1978

[54] HINGE MOUNTING MEANS

[75] Inventors: George G. Bergh; Robert G. Bergh, both of Plainville, Mass.

[73] Assignee: Bergh Bros. Co., Inc., Attleboro Falls, Mass.

[21] Appl. No.: 803,764

[22] Filed: Jun. 6, 1977

[51] Int. Cl.[2] ..... B65D 43/14; B65D 51/04

[52] U.S. Cl. ..... 220/334; 229/44 M; 16/128 R

[58] Field of Search ..... 403/380; 16/128 R, 159; 229/44 M; 220/334, 335, 342

[56] References Cited

U.S. PATENT DOCUMENTS

| | | | |
|---|---|---|---|
| 2,804,229 | 8/1957 | Bergh et al. | 220/334 |
| 3,233,820 | 2/1966 | Williams | 220/335 X |
| 3,355,088 | 11/1967 | Young | 220/342 X |
| 3,782,592 | 1/1974 | Bergh et al. | 220/334 |

*Primary Examiner*—George T. Hall

*Attorney, Agent, or Firm*—Thompson, Birch, Gauthier & Samuels

[57] ABSTRACT

A mounting means for fixing a hinge relative to a container wall. A hinge receiving element is provided with an inner plate having an outer lip joined thereto by an intermediate web. The container wall is received between and thus reinforced by the aforesaid inner plate and outer lip, with the intermediate web being supported on a wall edge. Preferably, the inner plate has upstanding ears, the intermediate web is notched at one end, and the container wall has inwardly protruding flange segments at opposite ends of the aforesaid wall edge. The notch permits both pivotal and lateral movement of the hinge receiving element in order to position the upstanding ears on the inner plate beneath and in contact with the undersides of the flange segments on the wall member. The inner plate is adapted to receive a hinge leaf in engagement therewith, and the hinge leaf, when thus engaged, prevents reverse lateral movement of the hinge receiving element.

17 Claims, 7 Drawing Figures

HINGE MOUNTING MEANS

BACKGROUND OF THE INVENTION

This invention relates generally to small hinged containers, for example those employed to package jewelry, pen and pencil sets, etc., and is concerned in particular with an improved mounting means for fixing the hinges relative to the container walls.

A number of hinge mounting arrangements have been developed in the past for mounting hinges on container walls. One such arrangement is illustrated in U.S. Pat. No. 3,355,088 where the hinge is attached directly to the container wall by means of sharp prongs on the hinge leaves. The prongs pierce the wall material and are then bent over to produce a mechanical interlock. A similar arrangement is shown in U.S. Pat. No. 1,626,301, although in this case the hinge leaves have perpendicular extensions attached directly to the bottom and top of the container. These types of arrangements have proven to be unsatisfactory because the prongs disfigure the exterior wall surfaces, and because the hinges tend to loosen after relatively little usage. Also, these arrangements require mechanical operations and associated equipment to insert and bend the prongs during assembly.

Another known arrangement is shown in U.S. Pat. No. 2,804,229. Here, the hinge leaf is provided with flanges and ears which cooperate in interlocked engagement with pocket-like recesses and hook members stamped out of the metallic container wall. While this type of arrangement is an improvement over those described above in that it is not likely to loosen, it still has the disadvantage of disfiguring the exterior wall surface.

Still another known arrangement is shown in U.S. Pat. No. 3,572,538. Here the hinge is attached to a hinge receiving element which is then wedged in place between inwardly protruding flanges on the container wall. The wedging is accomplished by employing additional insert members. While this arrangement does not disfigure the exterior wall surface, it is somewhat lacking in rigidity, and the need to employ additional insert members limits the ways in which the interior of the container can be decorated and used. Other similar arrangements are shown in U.S. Pat. Nos. 3,128,898 and 3,782,592.

Another problem which is common to all of the arrangements referred to above is that they do not reinforce or strengthen the container wall at the hinge location. Since the container wall is subjected to torsional and bending stresses originating at the hinge location, and since portions of the container wall and associated flanges are frequently cut away and thus weakened at this location in order to accommodate the hinge pintle, this lack of reinforcement is another serious drawback.

SUMMARY OF THE INVENTION

The present invention provides an improved mounting means for fixing a hinge relative to a container wall. A hinge receiving element is provided with an inner plate having an outer lip joined thereto by an intermediate web. The container wall is received relatively snugly between and thus reinforced by the aforesaid inner plate and outer lip, with the intermediate web being seated on a wall edge.

Preferably, the inner plate has upstanding ears and the intermediate web is notched at one end. Also, the container wall has inwardly protruding flange segments at opposite ends of the aforesaid wall edge, with the wall edge being of a length suitable to accommodate the hinge receiving element. The notch permits both pivotal and lateral movement of the hinge receiving element in order to position the upstanding ears on the inner plate beneath and in contact with the underside of the wall's flange segments. This vertically fixes the hinge receiving element with its intermediate web urged firmly against the underlying wall edge.

The inner plate is adapted to receive a hinge leaf in engagement therewith. When thus engaged, portions of the hinge leaf and/or the hinge pin are laterally confined by the container wall and/or its associated flange segments, thereby preventing reverse lateral movement of the hinge receiving element.

This arrangement offers a number of significant advantages. For example, and as previously mentioned, the hinge receiving element reinforces and strengthens the container wall at the hinge location, which is usually the place where the wall is weakest and where bending and torsional stresses originate during opening and closing of the container.

The outer lip of the hinge receiving element overlaps the exterior wall surface in a neat and attractive manner which enhances the overall appearance of the container. Unsightly holes, detents, depressions, slots, etc. are not present in the container wall.

The entire hinge mounting procedure can be done by hand, without the need for special tools or complicated mechanical operations. Also, separate insert members are not required because the hinge is itself the final locking element. This provides a cost saving while also providing greater flexibility.

DESCRIPTION OF PREFERRED EMBODIMENT

Figure 1:
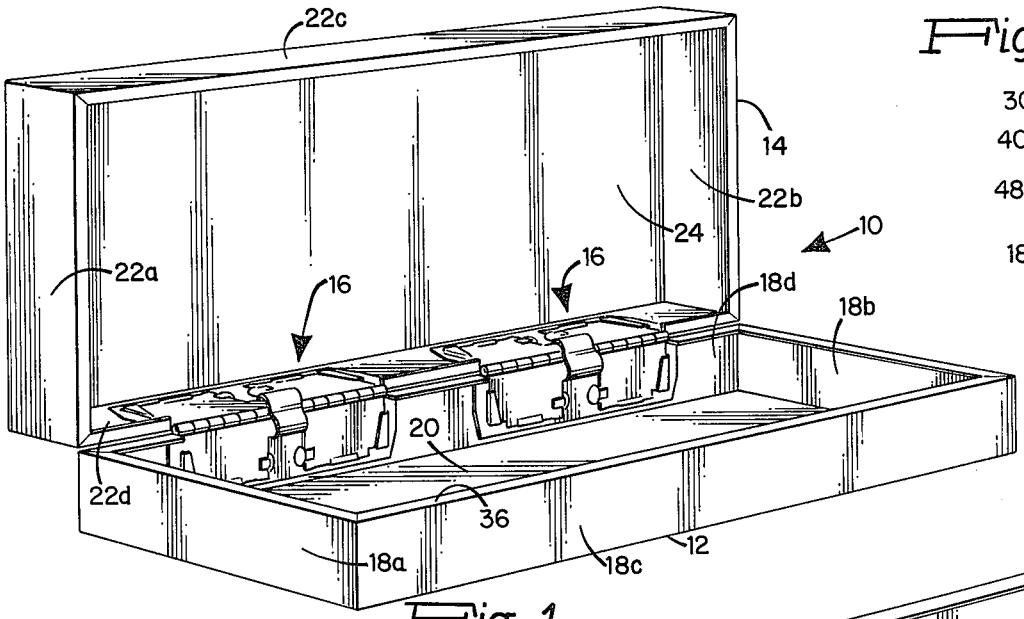
FIG. 1 is a front perspective view of an open hinged container embodying the concepts of the present invention.
Figure 7:
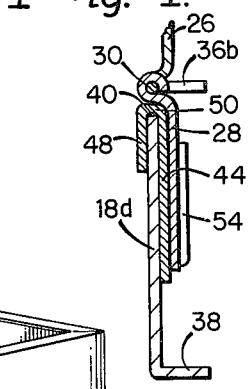

Referring now to the drawings, 10 designates a box-like container having a base or bottom 12 pivotally connected to a top or lid 14 by means of a pair of hinge assemblies generally indicated at 16. The base 12 has end walls 18*a*, 18*b*, front and back walls 18*c*, 18*d* and a bottom 20. Likewise, the lid 14 has side walls 22*a*, 22*b*, front and back walls 22*c*, 22*d* and a top 24.

Figure 3:
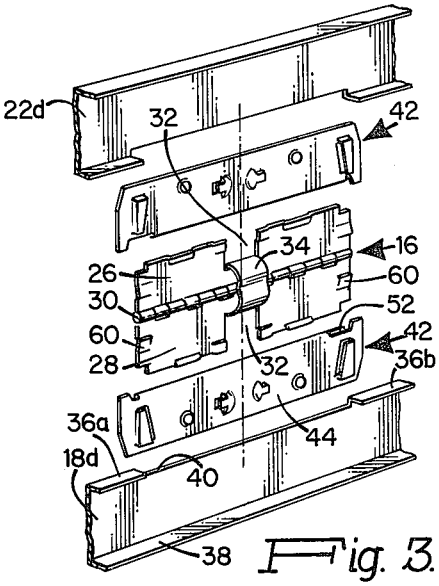
FIG. 3 is an exploded perspective view of the hinge mounting means of the present invention.
Figure 6:
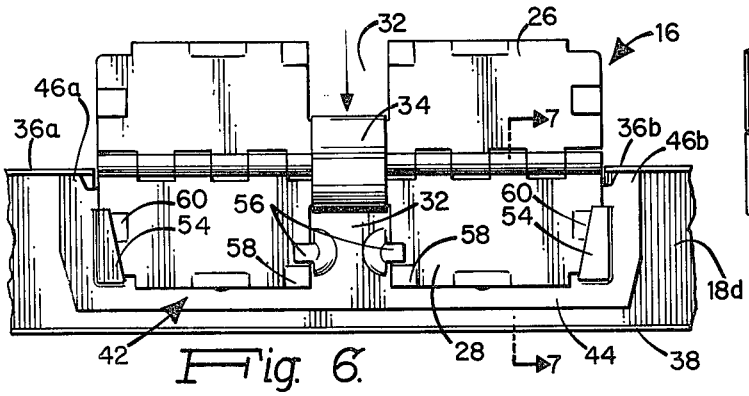
FIG. 6 is a view similar to FIGS. 4 and 5 showing the hinge being attached to the hinge receiving element; and, FIG. 7 is a sectional view taken along lines 7—7 of FIG. 6.

As is best shown in FIGS. 3 and 6, each hinge assembly 16 includes a pair of hinge leaves 26, 28 which are pivotally interconnected by means of a hinge pin 30, and which are centrally relieved as at 32 to accommodate a C-shaped spring 34.

The manner in which the hinge leaf 28 is fixed relative to the container wall 18*d* will now be described, it being understood that the other hinge leaf 26 is fixed relative to the container wall 22*d* in an identical manner. The container wall 18*d* is planar and it extends longitudinally between the side walls 18*a*, 18*b*. Peripheral flanges 36, 38 extend inwardly from the top and bottom edges, respectively, of the wall members 18*a*–18*d*. The flange portion extending inwardly from the top edge of the rear wall 18*d* is interrupted at each hinge location to provide flange members or segments 36*a*, 36*b* at opposite ends of a longitudinally extending wall edge 40. The wall edge 40 is parallel to the flange members 36*a*, 36*b*, and preferably it is spaced vertically beneath the plane of the wall flange 36 to thus comprise the bottom of a recess extending longitudinally between the flange members 36*a*, 36*b*.

A hinge receiving element generally indicated at 42 is designed for mounting on the wall member 18*d* between the flange members 36*a*, 36*b*. The hinge receiving element comprises an inner plate 44, preferably with locating ears 46*a*, 46*b* protruding therefrom, and an outer lip 48 joined to the inner plate by an intermediate web 50.

Preferably, the length of the outer lip 48 is approximately equal to the distance between the flange members 36*a*, 36*b*. The length of the inner plate 44 is longer than the distance between the flange members 36*a*, 36*b*, with the locating ears 46*a*, 46*b* being disposed at or adjacent to the opposite ends of plate member 44.

Figure 4:
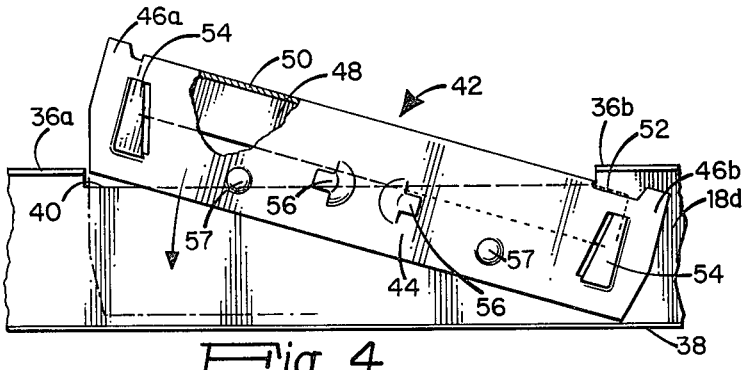
FIG. 4 is an elevational view showing the hinge receiving element being pivoted into an intermediate position on the container wall.
Figure 5:
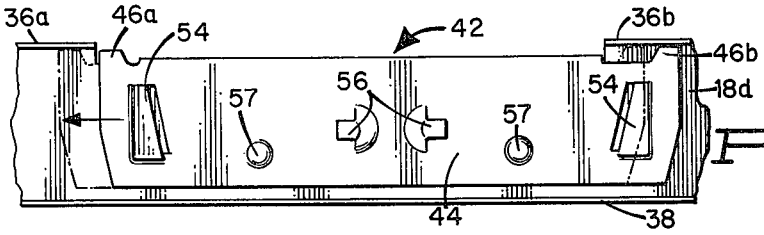
FIG. 5 is a view similar to FIG. 4 showing the hinge receiving element being moved laterally along the wall member into its seated position thereon.

The intermediate web 50 is notched or recessed at one end as at 52, with the length of the web being less than that of the wall edge 40. This permits the hinge receiving element 42 to be initially placed on the wall member 18*d* in the position shown in FIG. 4. The hinge receiving element is then pivoted downwardly about the inner edge of recess 52 to the intermediate position shown in FIG. 5. At this position, the locating ear 46*b* underlies the flange member 36*b*, the intermediate web 50 is seated on the wall edge 40, but the locating ear 46*a* remains uncovered by the flange member 36*a*. Thereafter, the hinge receiving element is slidably displaced laterally to the left as viewed in FIG. 5 to a final seated position at which the locating ears 46*a*, 46*b* respectively underlie the flange members 36*a*, 36*b* to thus urge the intermediate web 50 down against the wall edge 40 with the wall member 18*d* being held between the inner plate 44 and the outer lip 48. As a result of its being held relatively snugly between these two components, the wall member is reinforced and strengthened in the critical vicinity between the flange members 36*a*, 36*b*.

It will be understood that the aforesaid lateral movement of the hinge receiving element occurs in a direction parallel to the flange members 36*a*, 36*b*, and that once seated, movement of said hinge receiving element in a transverse direction is prevented by the engagement of the intermediate web 50 with the wall edge 40 and the engagement of the ears 46*a*, 46*b* with the flange members 36*a*, 36*b*.

After the hinge receiving element has been thus seated, the hinge leaf 28 is attached directly to the inner plate 44 by any convenient means not requiring tools or complicated mechanical operations. Preferably this is accomplished by a cooperative arrangement of flanges, ears, detents and recesses of the type described in U.S. Pat. No. 2,804,229. Typically, with such an arrangement, the inner plate 44 of the hinge receiving element will be stamped to provide opposed pocket-like recesses 54, raised buttons 57 and centrally located oppositely facing flanges 56. The hinge leaf 28 will be stamped to provide hook elements 58 and inclined ears 60. As viewed in FIG. 6, the hinge leaf 28 is pushed downwardly onto the inner plate 44 of the hinge receiving element, with the ears 60 being received in the pocket-like recesses 54 and with the hook elements 58 being engaged beneath the flanges 56. The buttons 57 push the hinge leaf away from the inner plate 44 and thus assist in establishing an interlocked engagement between the hook elements 58 and the flanges 56. When thus securely fastened to the inner plate 44, the hinge assembly 16 is confined between the flange members 36*a*, 36*b*, thereby precluding reverse lateral movement of the hinge receiving element 44 along the wall member 18*d* in a direction opposite to that indicated diagrammatically in FIG. 5. The hinge assembly 16 is thus securely fixed relative to the wall member 18*d*.

As stated previously, the same arrangement and procedure is employed to fix the other hinge leaf 26 relative to the rear wall 22*d* of the container lid 14.

Figure 2:
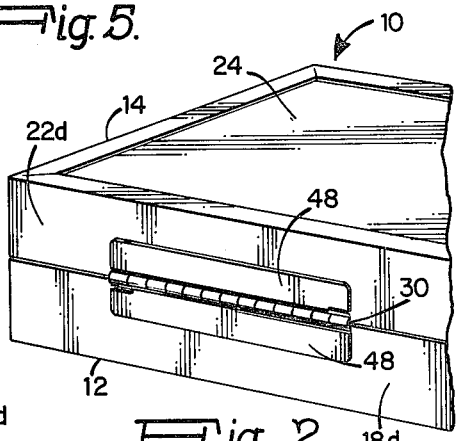
FIG. 2 is a partial rear perspective view of the same container in the closed position.

In light of the foregoing, it will be appreciated that in addition to the reinforcement feature mentioned above, a number of other significant advantages are provided by the present invention. For example, and as is best shown in FIG. 2, there is provided a neat and attractive exterior appearance characterized by the outer lips 48 overlapping the exterior surfaces of the rear walls 18*d*, 22*b* at each hinge location.

The entire hinge mounting procedure can be carried out without the need for accessory tools or complicated and time consuming mechanical operations normally required to deform metallic components.

As is best shown in FIG. 1, the hinges are attached to the container components in a manner which provides complete flexibility for use and/or decoration of the container interior without having to accommodate wedge-type hinge locating members.

It is our intention to cover all changes and modifications to the embodiment herein chosen for purposes of disclosure which do not depart from the spirit and scope of the invention as defined by the claims appended hereto.

We claim:

1. Mounting means for fixing a hinge relative to a container wall at a location thereon which is defined in part by a longitudinally extending wall edge, comprising: a hinge receiving element having an inner plate joined to an outer lip by an intermediate web; cooperating means on said hinge receiving element and said container wall for urging said intermediate web against the wall edge with said container wall being located between and reinforced by said inner plate and said outer lip; and, means for attaching the hinge to said inner plate.

2. The mounting means of claim 1 wherein said cooperating means comprises inwardly protruding flange members on the container wall at opposite ends of said wall edge, and locating ears on said inner plate arranged to engage the undersides of said flange members.

3. The mounting means of claim 1 wherein the length of said outer plate is approximately equal to the length of said wall edge.

4. The mounting means of claim 3 wherein the length of said inner plate is greater than the length of said outer plate.

5. The mounting means of claim 2 wherein said intermediate web is recessed at one end to accommodate limited movement of said hinge receiving element along said container wall.

6. Apparatus for mounting a hinge assembly on the wall of a container, the hinge assembly having a pair of hinge leaves pivotally interconnected by a hinge pin and the container wall having inwardly extending peripheral flange segments at opposite ends of an elongated recess in the container wall, the said recess being defined in part by a bottom edge parallel to said flange segments, said apparatus comprising: a hinge receiving element having an inner plate overlying the inner container wall surface, said inner plate being joined to an outer lip overlying the outer container wall surface by an intermediate web, locating means on said inner plate cooperating with said flange segments to urge said intermediate web against the bottom edge of said recess, and means for attaching one of said hinge leaves to said inner plate at a location confined between said flange segments.

7. The apparatus of claim 6 wherein said locating means is comprised of a pair of upstanding ears, the distance between said ears being greater than the distance between the opposed ends of said flange segments.

8. The apparatus of claim 7 wherein said intermediate web is recessed at one end to accommodate movement of said hinge receiving element between an intermediate position at which only one of said ears underlies one of said flange segments and a seated position at which each of said ears underlies one of said flange segments.

9. The apparatus of claim 8 wherein once a hinge leaf is attached to said inner plate, further movement of said hinge receiving element between said intermediate and seated positions is prevented by the confinement of said hinge receiving element between the said flange segments.

10. A container and hinge assembly combination, comprising: a container wall having an inwardly extending peripheral flange, said flange and said wall being cut away to provide an interruption in said flange and an elongated first recess in said wall, said first recess having a bottom edge parallel to said flange and end edges leading from said bottom edge to said flange; a hinge receiving element having an inner plate integrally joined to an outer lip by an intermediate web, said web being located between upstanding ears on said inner plate, said web having an elongated second recess at one end thereof which is dimensioned to accommodate mounting of said hinge receiving element on said container wall with said upstanding ears underlying and in engagement with said flange, and with said inner plate, intermediate web and outer lip overlapping respectively the interior surface of said container wall, said bottom edge of the outer surface of said container wall; a hinge having leaves pivotally interconnected by a hinge pin; and means for attaching one of said hinge leaves to said inner plate.

11. The combination of claim 10 wherein the length of said second recess is sufficient to accommodate an initial positioning of said hinge receiving element on said container wall with only one of said upstanding ears underlying said flange.

12. The combination of claim 11 wherein said hinge receiving element is movable relative to said container wall in a direction parallel to said flange between said initial position and a seated position at which both of said upstanding ears underlie said flange.

13. The combination of claim 12 wherein said hinge receiving element is held in said seated position against movement in a direction transverse to said first-mentioned direction by the engagement of said intermediate web with said botton edge and by the engagement of both said upstanding ears with said flange.

14. The combination of claim 6 wherein the length of said intermediate web is less than the length of said bottom edge.

15. The combination of claim 14 wherein the length of said outer lip is approximately equal to the length of said bottom edge.

16. For use in combination with a container wall having an inwardly extending peripheral flange with both the flange and the wall being cut away to provide an interruption in the flange adjacent to an elongated recess in the wall, and a hinge having leaves pivotally interconnected by a hinge pin, the improvement comprising: a hinge receiving element having an inner plate integrally connected to a downturned outer lip by an intermediate web, a pair of upstanding ears on said inner plate, the length of said intermediate web in relation to the length of said recess and the distance between said ears being such as to accommodate positioning of said hinge receiving element on said container wall with said intermediate web held against the bottom of said recess by the cooperative engagement of both of said ears with the underside of said flange, and means for attaching one of the hinge leaves to said inner plate at a location such that removal of said hinge receiving element from the container wall is prevented by engagement of said one hinge leaf with said flange.

17. For use in mounting a hinge on a container wall, the hinge having leaves pivotally interconnected by a hinge pin and the container wall having an inwardly extending peripheral flange with both the flange and the wall being cut away to provide an interruption in the flange adjacent to an elongated recess in the wall, the improvement comprising: a hinge receiving element having an inner plate overlying the inner surface of said container wall, said inner plate being joined to an outer lip overlying the outer surface of said container wall by an intermediate web overlying the bottom of said recess; ear members on said inner plate engagable with said flange for holding said hinge receiving element in a seated position with said intermediate web engaging the bottom of said recess, the length of said web being such as to permit movement of said hinge receiving element relative to said container wall between an intermediate position with only one of said ear members in engagement with said flange and said seated position; and means for attaching one of the hinge leaves to said inner plate with the hinge pin located between the ends of said recess, thereby precluding further movement of said hinge receiving element between said intermediate and seated positions.

* * * * *